US005386773A

United States Patent [19]

Flade

[11] Patent Number: 5,386,773

[45] Date of Patent: Feb. 7, 1995

[54] INK DOSING APPARATUS FOR PRINTING PRESS

[75] Inventor: Gregor Flade, Meckesheim, Germany

[73] Assignee: Heidelberger Druckmaschinen Aktiengesellschaft, Heidelberg, Germany

[21] Appl. No.: 166,087

[22] Filed: Dec. 10, 1993

[30] Foreign Application Priority Data

Dec. 11, 1992 [DE] Germany ..... 4241809

[51] Int. Cl.[6] ..... B41F 31/02; B41F 31/08

[52] U.S. Cl. ..... 101/366

[58] Field of Search ..... 101/365, 366, 363, 350, 101/148, 207–210; 118/259, 267; 222/501, 504, 506, 509, 559

[56] References Cited

U.S. PATENT DOCUMENTS 2,581,687 1/1952 McWhorter ..... 101/DIG. 38
4,392,426 7/1983 Wege ..... 101/365

FOREIGN PATENT DOCUMENTS 2402433 8/1974 Germany .

*Primary Examiner*—J. Reed Fisher
*Attorney, Agent, or Firm*—Nils H. Ljungman & Associates

[57] ABSTRACT

An ink box device for printing units with a closed ink container with an opening on the lower end, with a means to close the opening and with means to introduce compressed air into the ink container, on which ink can be applied over the length of an ink ductor roller in controlled quantities for each individual zone, without any wear parts coming into contact with the inking roller.

17 Claims, 3 Drawing Sheets

INK DOSING APPARATUS FOR PRINTING PRESS

BACKGROUND OF THE INVENTION

1. Field of the Invention

This invention relates to an ink box device for printing units with a closed ink container with an opening on the lower end, with a means to close the opening and with means to introduce compressed air into the ink container.

2. Background Information

DE 24 02 433 A1 discloses a known unit similar to that described above, with a closed ink container which has an opening on the lower end, through which opening the ink can exit. But this known ink container is essentially only capable of depositing a narrow stream of ink on a gravure plate, which ink is then brushed into the recesses of the gravure plate. This known arrangement is not suited for feeding and dosing the ink over the width of an inking unit, such as on an offset printing unit.

OBJECT OF THE INVENTION

On the basis of the known arrangement just described, the object of the present invention is to create an ink box device which applies a quantity of ink which can be individually adjusted for each zone over the length of an inking unit roller, and in which no wear parts are in contact with the inking roller.

SUMMARY OF THE INVENTION.

The invention teaches that this object can be achieved in that the ink container which extends over the printing width of the printing unit, which ink container has an opening designed as a slot which extends over the length of the ink container, wherein there are slides underneath the opening which can be displaced at right angles to the longitudinal direction of the opening and which slides have recesses in the vicinity of the opening, by means of which the width of the opening can be changed in individual zones, and the slides have actuator drives to adjust the width of the slot. With this solution, it is possible to discharge measured quantities of ink from the slot-shaped opening, so that in each zone, only the amount of ink required for the current image is deposited on the inking roller. With the above-described configuration, no wearing parts come into contact with the inking roller, so that there is essentially no mechanical influence exerted on the inking roller, and a replacement or adjustment of the wearing parts is no longer necessary. When printing begins, all that is necessary is to insert a filled ink container and to set the individual slides, e.g. on the basis of measurement results. Printing can then start immediately.

In accordance with an advantageous configuration of the invention, the slot-shaped opening can be closed by a wedge-shaped strip, so that essentially no ink can escape from the container., i.e. when the container is removed from the printing press. The wedge-shaped strip is also preferably mounted so that it can be raised by means of an actuator to open the slot-shaped opening, so that when the ink container is inserted into the press, the slot opens either automatically or manually, when an operator presses a button.

An additional advantageous configuration is characterized by the fact that the slides are preferably mounted on mounting crossarms underneath support crossarms for the ink container and overhang the mounting crossarms on both sides, that the support crossarms for the ink container, underneath the opening in the ink container, essentially form a slot for the ink, and that the two sides of the slides are connected by webs in the vicinity of the recesses. Both the mounting and the manufacture of the slides can be done very economically.

In one advantageous configuration of the invention, there are preferably actuators on both sides of the slides, which move the individual slides by means of servomotors as a function of the desired slot width. It is advantageous if on both sides of the slides, an actuator is mounted so that .it can move lengthwise on a crossarm along the slides, and if a servomotor for each actuator positions the individual slides in sequence by means of a worm gear and a push button, or lever. The positioning of the individual slides can thereby be controlled automatically, e.g. by a special program, or else manually by the operator of the printing unit.

Additional advantageous configurations are characterized by the fact that the longitudinal movement of the actuators can preferably take place by means of toothed belts which can be driven by stepper motors. There can also be connections for washing fluid in the support crossarms, and when the ink container is removed during the washing, brushes can be lowered from above onto the slides to brush them. Thus a change of ink can be done automatically, and the washing fluid which acts on the inking rollers can also be used to promote the washing of the inking unit.

In summary, one aspect of the invention resides broadly in a printing press comprising: a frame; a plate cylinder being rotatably mounted on the frame; a plurality of ink applicator rollers for being engaged with the plate cylinder and for applying ink to the plate cylinder; a plurality of inking rollers for applying ink to the plurality of ink applicator rollers; the plate cylinder having a printing width for accommodating ink, and the plurality of inking rollers having an inkable width corresponding to the printing width of the plate cylinder; the plurality inking rollers defining a plurality of zones throughout the inkable width thereof; means for supplying ink to the plurality of inking rollers; a receiving roller for receiving ink from the ink supplying means and for distributing the ink among the plurality of inking rollers, the receiving roller having an inkable width corresponding to the inkable width of the plurality of inking rollers; the ink supplying means comprising: means for holding a supply of ink; the holding means having a lower portion disposed towards the receiving roller; at least one opening disposed in the lower portion of the holding means, the at least one opening being positioned to supply ink to the receiving roller over substantially the entire inkable width of the receiving roller; a plurality of slides being slidably mounted below the at least one opening; the plurality of slides being configured for varying the flow of ink to each of the zones, each of the slides corresponding to one of the zones; and means for selectively positioning the slides to adjust the slides to vary the flow of ink to the zones corresponding to the slides.

Another aspect of the invention resides broadly in ink dosing apparatus for supplying ink to a plurality of inking roller in a printing press, such a printing press comprising: a frame; a plate cylinder being rotatably mounted on the frame; a plurality of ink applicator rollers for being engaged with the plate cylinder and for applying ink to the plate cylinder; a plurality of inking rollers for applying ink to the plurality of ink applicator rollers; the plate cylinder having a printing width for accommodating ink, and the plurality of inking rollers having an inkable width corresponding to the printing width of the plate cylinder; the plurality inking rollers defining a plurality of zones throughout the inkable width thereof; a receiving roller for receiving ink from the ink dosing means and for distributing the ink among the plurality of inking rollers, the receiving roller having an inkable width corresponding to the inkable width of the plurality of inking rollers; the ink dosing apparatus comprising: means for holding a supply of ink; the holding means having a lower portion for being disposed towards the receiving roller; at least one opening disposed in the lower portion of the holding means, the at least one opening for being positioned to supply ink to the receiving roller over substantially the entire inkable width of the receiving roller; a plurality of slides being slidably mounted below the at least one opening; the plurality of slides being configured for varying the flow of ink to each of the zones, each of the slides corresponding to one of the zones; and means for selectively positioning the slides to adjust the slides to vary the flow of ink to the zones corresponding to the slides.

Yet another aspect of the invention resides broadly in ink dosing apparatus for supplying ink to a receiving roller of a printing press, the receiving roller having an inkable width, the receiving roller defining a plurality of zones throughout the inkable width thereof, the printing press having a frame, the ink dosing apparatus comprising: means for holding a supply of ink; the holding means having a lower portion for being disposed towards the receiving roller; at least one opening disposed in the lower portion of the holding means, the at least one opening for being positioned to supply ink to the receiving roller over substantially the entire inkable width of the receiving roller; a plurality of slides being slidably mounted below the at least one opening; the plurality of slides being configured for varying the flow of ink to each of the zones, each of the slides corresponding to one of the zones; and means for selectively positioning the slides to adjust the slides to vary the flow of ink to the zones corresponding to the slides.

BRIEF DESCRIPTION OF THE DRAWINGS

One embodiment of the invention is schematically illustrated in the accompanying drawings, wherein.

DESCRIPTION OF THE PREFERRED EMBODIMENTS

Figure 1:
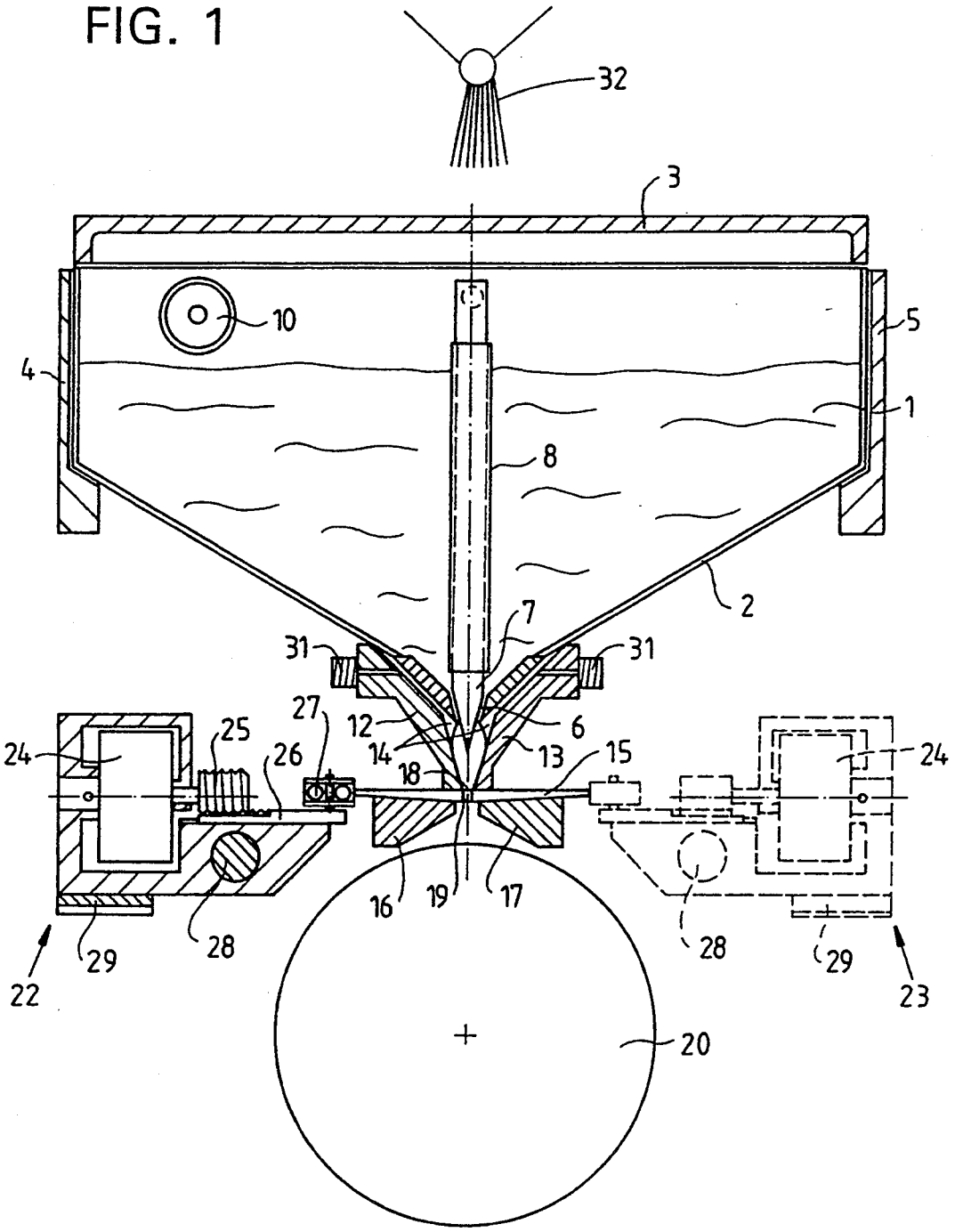
FIG. 1 shows a cross section through the ink box device.
Figure 1A:
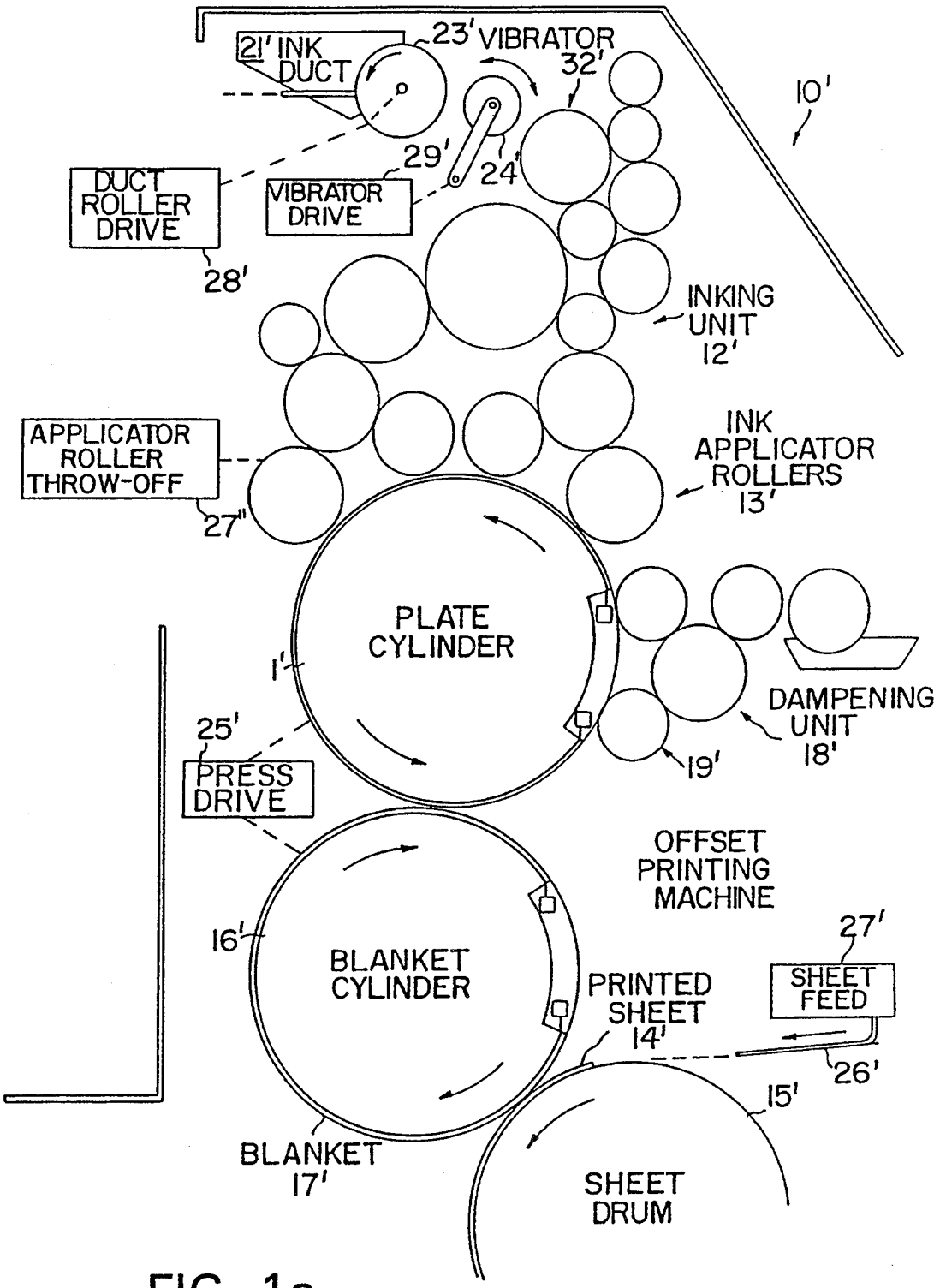
FIG. 1*aa* schematically illustrates a printing press in which the present invention may be employed.

Referring first to FIG. 1*aa*, a rotary print stand 10' of a rotary printing press generally includes: a plate cylinder 1' for having mounted thereon a printing plate; and inking unit 12' which includes ink applicator rollers 13' for applying to the printing plate an ink profile; a dampening (or wetting) unit 18' having dampening applicator rollers 19' for transferring a dampening agent to the printing plate or image-carrying foil, a blanket cylinder 16' carrying a rubber blanket 17' for receiving an ink impression from the printing plate or image-carrying foil, and a sheet drum 15' from carrying a printed sheet 14' onto which the ink impression carried by blanket 17' is transferred. A duct roller 23' is typically mounted adjacent to ink duct 21'. Typically, ink is transferred from duct roller 23' to inking unit 12' by means of a vibrator roller 24' which oscillates to successively pick up ink from duct roller 23' and deposit the same on a roller 32' of inking unit 12'. Typically, the printing stand 10' will also include auxiliary mechanisms such as, for example, a duct roller drive 28', a vibrator roller drive 29', an applicator roller throw-off 27'' for lifting the ink applicator rollers 13' off of the printing plate, a press drive 25' and a sheet feed 27' for supplying the sheets to be printed 26' to sheet drive drum 15'.

Figure 2:
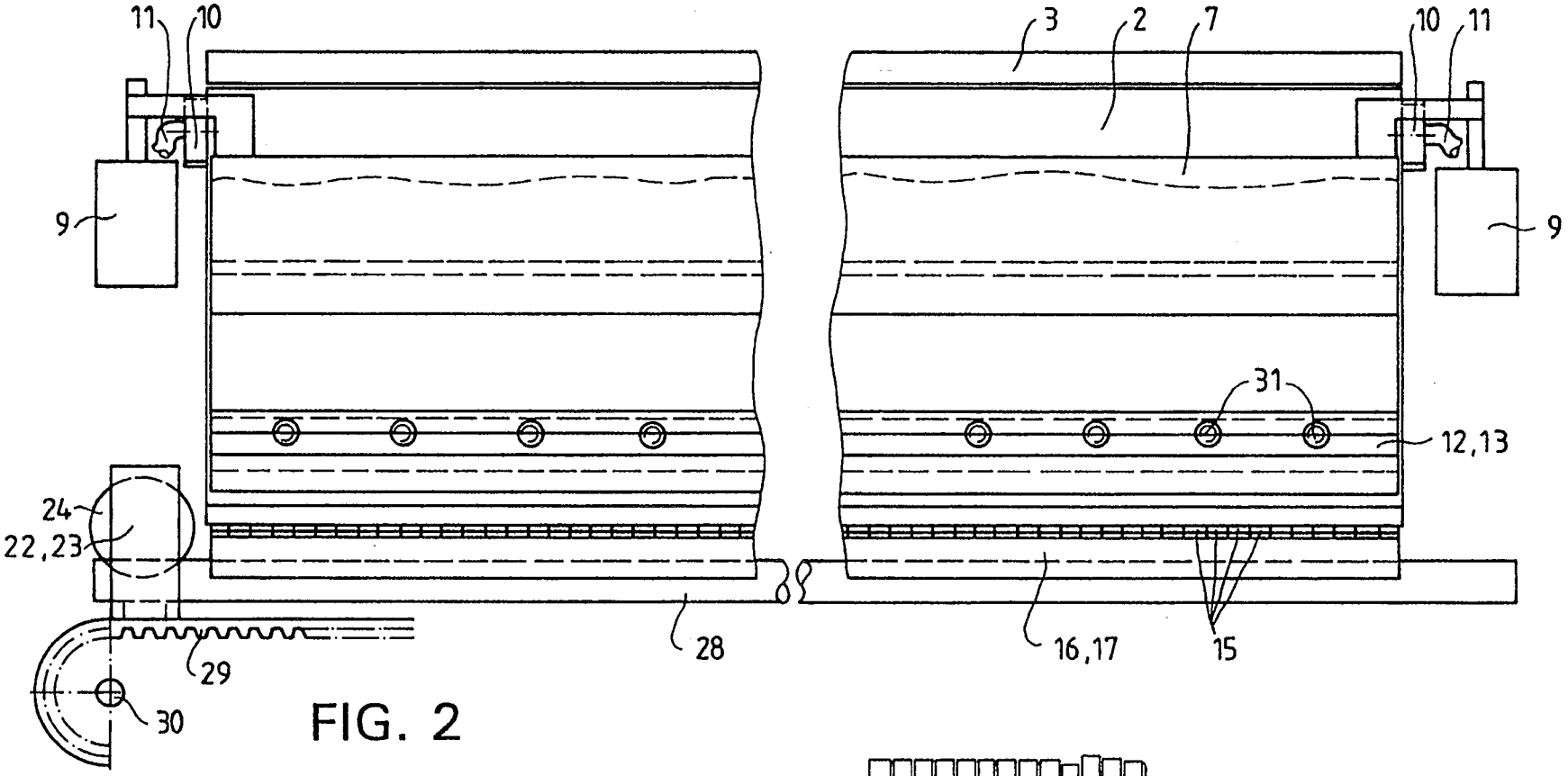
FIG. 2 shows a side view of the ink box device.

Referring now to FIG. 1, the ink container 2 filled with ink 1 is preferably closed pressure-tight by a cover 3. On both sides, the ink container 2 can preferably be inserted in crossarms 4, 5 which are fastened to the side frames of the printing unit. On the lower end, the ink container 2 preferably has an opening 6 which extends essentially all the way along the ink box itself, or over the printing width of the printing unit. The opening 6 is preferably in the form of a slot, and can preferably be closed by means of a wedge-shaped strip 7. The strip 7 is preferably mounted on both ends in slip-in guides 8 which are fastened in the ink container 2. To open the slot-shaped opening 6, there is preferably an actuator 9, as shown in FIG. 2, on both sides of container 2 in the upper portion of the strip 7, by means of which the wedge-shaped strip 7 can be raised. Compressed air lines 11 can be connected to the ink container 2 by means of quick-release connections 10, so that a controlled overpressure can be applied to the ink 1 in the ink container.

Thus, essentially, in accordance with a preferred embodiment of the present invention, the opening 6 of the ink container 2 preferably extends across substantially the entire printing width of the printing unit, or that width over which a printing plate on the plate cylinder 1' may receive ink. Opening 6 can preferably be entirely closed by means of wedge-shaped strip 7. Thus, whereas, as discussed further below, the arrangement of slides according to the present invention can adjust the flow of ink through individual zones, the wedge-shaped strip 7 can effectively interrupt the flow of ink to all zones. Actuator 9 may essentially be embodied by any device appropriate for lifting and lowering wedge-shaped strip 7, such as an electric motor with a simple mechanical arm.

As shown in FIG. 1, opening 6 is preferably located at a lower, tapered portion of ink container 2, and wedge-shaped strip 7 preferably has a wedge end which can be accommodated by the taper of ink container 2. Compressed air lines 11, which are preferably connected to a compressed air unit (not shown), preferably feed into quick-release connection 10 to provide a controlled overpressure, essentially pressure over atmospheric pressure, to the interior of ink container 2 to promote the supply of ink 1 from the interior of ink container 2 to inking roller 20. Ink container 2 may be alternatively termed "ink fountain" or "ink duct". Inking roller 20 may preferably constitute an inking roller in inking unit 12' or, alternatively, may constitute duct roller 23'.

In the lower portion, the ink container preferably rests on two support crossarms 12, 13, from which the ink container 2 can be sealed off by means of rubber lips 14. Slides 15 are preferably in contact with the lower end of the support crossarms 12, 13 and are supported by crossarms 16, 17. The slides can preferably be designed to have the width of one zone, and are preferably disposed tight up against one another. There are preferably as many slides located next to one another as necessary to cover the entire length of the slot 6. The slides 15 can thereby be moved between the support crossarms 12 and 13 and the crossarms 16, 17 at right angles to the longitudinal direction of the slot 6. The two support crossarms 12, 13 can preferably leave a slot 18 between them open in the vicinity of the slides 15, through which the ink can escape. In the vicinity of the slot 18, there are preferably recesses 19 in the slides 15, through which, depending on the position of the slides 15, more or less ink can be allowed to flow, which is then deposited preferably on the first inking roller 20 of the inking unit.

Thus, in accordance with a preferred embodiment of the present invention, crossarms 12, 13 are preferably provided to support ink container 2 and preferably extend across the printing unit. Thus, in conjunction with crossarms 4, 5, crossarms 12, 13 preferably provide for support ink container 2 and, as such, can preferably accommodate successive ink containers interchangeably. Preferably, each slide 15 corresponds to, and has the width of, one zone, and are preferably positioned in immediate succession with respect to one another.

Figure 3:
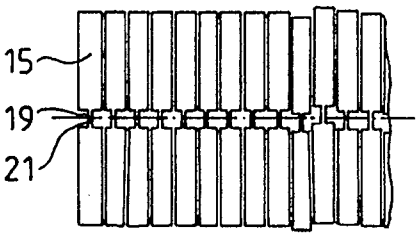
FIG. 3 shows a plan view of the configuration of slides according to the present invention.

Both sides of the slides 15 are preferably connected to one another by webs 21 in the vicinity of the recesses 19. For this purpose FIG. 3 shows a schematic plan view of the slides 15. The figure also illustrates the different position of the slides in the longitudinal direction.

Thus, in accordance with a preferred embodiment of the present invention, each slide 15 is preferably shaped such that each slide 15 has a constant width save for a "pinched" portion at a central area of slide 15. Particularly, along the length of slide 15, towards the midpoint, there are preferably two recesses 19 flanking a narrow web 21, which narrow web 21 preferably connects two distinct sections of slide 15 which have the constant width, as just described. Thus, ink flowing via a particular slide 15 preferably flows through recesses 19 and, accordingly, astride web 21.

It is conceivable, within the scope of the present invention, to have, among others, a slide arrangement such as one wherein each slide 15 has a constant width over the entire length thereof and has an opening in the vicinity of the midpoint of slide 15.

The slides 15 preferably overhang the crossarms 16, 17 on both sides, so that the actuators 23, 23 can act on them. It is advantageous if there is an actuator 22 not only on one side, but if there is an additional actuator 23 on the opposite side of the slides 15, so that both actuators 22, 23 can work together to move the slides 15. Depending on how far the recesses 19 overlap the slot 18, more or less ink is pushed through the available opening. In one preferred embodiment of the present invention, each actuator is thereby preferably equipped with a servomotor 24 which acts by means of a worm gear 25 and a push button, or lever, or key, 26 with a ball bearing 27 on the ends of the slides 15, to position the slides. The servomotor 24 can be a stepper motor, which makes a very precise adjustment of the slides by means of the worm gear.

Conceivably, so that there is no need to have an individual pair of actuators 22, 23 for each slide 15, only one pair of actuators 22, 23 can preferably be mounted on a crossarm 28 on either side of the slides 15 so that the pair can move longitudinally along the slides 15. To move the actuators 22, 23, there can preferably be toothed belts 29 which can be driven by stepper motors 30. If the adjustment of a slide 15 is desired or has been programmed, the respective actuator 22 or 23 can move into the position of the desired slide 15 and push the slide somewhat further between the crossarms 12, 13 or 16, 17, so that depending on the position of the slide 15, the opening of the slot 18 is expanded or reduced. Thus the amount of ink in each zone can be adjusted fully automatically. The ball bearing 27 has the advantage that, for example if several slides 15 are to be set identically one after the other, the servomotor 24 need not be activated, but only the toothed belt 29 needs to be driven so that all the slides 15 are set to the same setting, which may be necessary, for example, if the flow of ink to a certain area is being shut off.

Thus, in accordance with a preferred embodiment of the present invention, it is possible to provide only one set of actuators 22, 23 for the entire set of slides 15. In such a configuration, an arrangement is preferably provided for moving the actuators 22, 23 either singly or in tandem and, as such, to index particular slides 15 which are to be adjusted. Ball bearing 27 is preferably configured to set a series of slides 15 to identical positions with respect to one another. In such an instance, there would essentially be no need to activate Servomotors 24, so that the levers 26 would essentially remain in a constant position. Thence, the toothed belt 29 or other drive would essentially move the actuators 22, 23 with the levers 26 held in constant position. Ball bearing 27, on the appropriate side of slides 15, would then essentially approach a protruding slide 15, contact slide 15, and roll along the end edge of slide 15 to displace slide 15 into the position determined by the positions of levers 26.

In the support crossarms 12, 13 there are preferably connections 31 for washing fluid, so that when the ink container 2 is removed, washing fluid can be applied to the inking roller 20 by means of the support crossarms 12, 13, the slot 18 and the recesses 19. To promote the washing action, brushes 32 can be lowered from above onto the slides 15, which can then brush the slides, e.g. by lengthwise motion of the rows of brushes. The dosing means for the ink can thus be cleaned easily, e.g. if a new ink container with a different ink is being installed. The dirty washing fluid on the inking roller can then be removed by a washing unit which may be part of the inking mechanism.

One feature of the invention resides broadly in the ink box device for printing units with a closed ink container with an opening on the lower end, with a means to close the opening and with means to introduce compressed air into the ink container, characterized by the fact that the ink container 2 extends across the printing width of the printing unit, that the opening 6 in the ink container 2 is designed in the form of a slot which extends over its length, that below the opening 6 there are slides 15 which can be moved at right angles to the longitudinal direction of the opening 6, and have recesses 19 in the vicinity of the opening 6, by means of which the slot width of the opening 6 can be changed in individual zones, and that the slides 15 have actuators 22, 23 to adjust the width of the slot.

Another feature of the invention resides broadly in the ink box device, characterized by the fact that the slot-shaped opening 6 can be closed by a wedge- shaped strip 7, and that the wedge-shaped strip 7 is mounted so that it can be raised by an actuator 9 to open the slot-shaped opening.

Yet another feature of the invention resides broadly in the ink box device, characterized by the fact that the slides 15 are mounted underneath the support crossarms 12, 13 for the ink container 2 on crossarms 16, 17, and overhang the crossarms 16, 17 on both sides, that the support crossarms 12, 13 have a slot 18 for the ink underneath the opening 6, and that the two sides of the slides 15 are connected in the vicinity of the holes 19 by webs 21.

Still another feature of the invention resides broadly in the ink box device, characterized by the fact that on both sides of the slides 15 there are actuators 22, 23 which, by means of servomotors 24, move the individual slides 15 as a function of the desired slot width.

Yet still another feature of the invention resides broadly in the ink box device, characterized by the fact that on both sides of the slides 15 there is an actuator 22, 23 mounted on a crossarm 28 so that it can move lengthwise along the slides 15, and that one servomotor 24 for each actuator 22, 23 positions the individual slides 15 in sequence by means of a worm gear 25 and a push button 26.

Still yet another feature of the invention resides broadly in the ink box device, characterized by the fact that the longitudinal movement of the actuators 22, 23 is achieved by means of toothed belts 29, which can be driven by stepper motors 30.

Yet another feature of the invention resides broadly in the ink box device, characterized by the fact that there are connections 31 for washing fluid in the support crossarms 12, 13, and that when the ink container 2 is removed during the washing process, brushes 32 can be lowered from above onto the slides 15 and can brush them.

Examples of printing presses and components associated therewith, which may be utilized in accordance with the embodiments of the present invention, may be found in the following U.S. Pat. No. 5,170,706, which issued to Rodi et al. on Dec. 15, 1992; No. 5,081,926, which issued to Rodi on Jan. 21, 1992.; and No. 5,010,820, which issued to Löffler on Apr. 30, 1991.

Examples of arrangements of servomotors and worm gears, which may be utilized in accordance with the embodiments of the present invention, may be found in the following U.S. Pat. No. 5,033,996, which issued to Frey on Jul. 23, 1991; No. 4,484,496, which issued to Weis on Nov. 27, 1984; and No. 3,998,108, which issued to Vyskocil on Dec. 21, 1976.

Examples of control arrangements for servomotors, which may be utilized in accordance with the embodiments of the present invention, may be found in the following U.S. Pat. No. 5,004,968, which issued to Mizuno et al. on Apr. 2, 1991; No. 4,994,978, which issued to Kawamura et al. on Feb. 19, 1991; and No. 4,575,666, which issued to Nakashima et al. on Mar. 11, 1986.

Examples of stepper motors, which may be utilized in accordance with the embodiments of the present invention, may be found in the following U.S. Pat. No. 5,254,892, which issued to Bosman et al. on Oct. 19, 1993; No. 5,247,216, which issued to Bosman et al. on Sep. 21, 1992; and No. 5,237,250, which issued to Zeile et al. on Aug. 17, 1993.

Examples of arrangements for providing compressed air, which may be utilized in accordance with the embodiments of the present invention, may be found in the following U.S. Pat. No. 5,153,603, which issued to Spence on Oct. 6, 1992; and No. 4,998,475, which issued to John et al. on Mar. 12, 1991.

Examples of quick-release connections, which may be utilized in accordance with the embodiments of the present invention, may be found in the following U.S. Pat. No. 4,996,982, which issued to Williamson on Mar. 5, 1991; No. 4,645,465, which issued to Courtney on Feb. 24, 1987; and No. 4,185,670, which issued to Sartell on Jan. 28, 1980.

An example of an automatic brush arrangement, which may be utilized in accordance with the embodiments of the present invention, may be found in the following U.S. Pat. Nos.: No. 4,192,231, which issued to Kawakami on Mar. 11, 1980.

Finally, examples of indexing arrangements, which may be utilized in accordance with the embodiments of the present invention, may be found in the following U.S. Pat. Nos.: No. 4,732,467, which issued to Sweeney on Mar. 22, 1988; No. 4,453,807, which issued to Faulkner et al. on Jun. 12, 1984; and No. 4,820,911, which issued to Arackellian et al. on Apr. 11, 1989.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 42 41 809, filed on Dec. 11, 1992, having inventor Gregor Flade, and DE-OS P 42 41 809 and DE-PS P 42 41 809, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

Nomenclature

1' Plate cylinder
10' Printing stand
12' Inking unit
13' Ink applicator rollers
14' Printed sheet
15' Sheet drum
16' Blanket cylinder
17' Rubber blanket
18' Dampening unit
19' Dampening applicator rollers
21' Ink duct
23' Duct roller
24' Vibrator roller
25' Press drive
26' Sheets to be printed
27' Sheet feed 27″ Applicator roller throw-off
28′ Duct roller drive
29′ Vibrator roller drive
32′ Roller
1 Ink
2 Ink container
3 Cover
4 Crossarm
5 Crossarm
6 Opening
7 Strip
8 Slip-in guide
9 Actuator
10 Quick-release connection
11 Compressed air line
12 Support crossarm
13 Support crossarm
14 Rubber lip
15 Slides
16 Crossarm
17 Crossarm
18 Slot
19 Hole
20 Inking roller
21 Web
22 Actuators
23 Actuators
24 Servomotor
25 Worm gear
26 Push button
27 Ball bearing
28 Crossarm
29 Toothed belt,
30 Stepper motor
31 Connection
32 Brushes

What is claimed is:

1. A printing press comprising:

a frame;

a plate cylinder being rotatably mounted on said frame;

a plurality of ink applicator rollers for being engaged with said plate cylinder and for applying ink to said plate cylinder;

a plurality of inking rollers for applying ink to said plurality of ink applicator rollers;

said plate cylinder having a printing width for accommodating ink, and said plurality of inking rollers having an inkable width corresponding to the printing width of said plate cylinder;

said plurality of inking rollers defining a plurality of zones along the inkable width thereof;

means for supplying ink to said plurality of inking rollers;

a receiving roller for receiving ink from said ink supplying means and for distributing the ink among said plurality of inking rollers, said receiving roller having an inkable width corresponding to the inkable width of said plurality of inking rollers;

said ink supplying means comprising:

means for holding a supply of ink;

said holding means having a lower portion disposed towards said receiving roller;

at least one opening disposed in said lower portion of said holding means, said at least one opening being positioned to supply ink to said receiving roller over substantially the entire inkable width of said receiving roller;

a plurality of slides being slidably mounted below said at least one opening;

said plurality of slides being configured for varying the flow of ink to each of said zones, each of said slides corresponding to one of said zones;

means for selectively positioning said slides to adjust said slides to vary the flow of ink to the zones corresponding to said slides;

each of said slides comprising at least one open area for permitting the flow of ink therethrough;

said at least one open area Of each said slide being adjustable with respect to said at least one opening of said holding means to vary the flow of ink to the zone corresponding to each said slide; and said positioning means comprising actuator means for sliding each of said slides to adjust said at least one open area of each said slide with respect to said at least one opening of said holding means to vary the flow of ink to the zone corresponding to each said slide.

2. The printing press according to claim 1, wherein:

said holding means comprises a container for holding ink, said container having a longitudinal dimension defined parallel to the inkable width of said inking rollers; and said at least one opening is one opening, said opening comprising a slot extending over the longitudinal dimension of said holding means.

3. The printing press according to claim 2, wherein said slides are mounted alongside one another, transversely across said printing press, to move in a direction perpendicular to the longitudinal dimension of said container.

4. The printing press according to claim 3, wherein said slides are mounted horizontally.

5. The printing press according to claim 4, wherein:

said ink supplying means further comprises means for closing said opening of said container to completely prevent the flow of ink to said zones through said slides;

said ink supplying means further comprises means for introducing an overpressure into said container to propel the ink through said opening;

said means for introducing an overpressure comprises means for introducing compressed air into said container;

said closing means comprises wedge means for being inserted in said opening to close said opening;

said ink supplying means further comprises means for selectively raising and lowering said wedge means to selectively open and close said opening;

said ink supplying means further comprises first crossarm means for supporting said container, said first crossarm means being mounted on said frame and extending transversely across said printing press;

said first crossarm means comprising a first crossarm and a second crossarm, said first and second crossarms being disposed parallel to one another;

said first and second crossarms each have a first portion for accommodating said container and a and a second portion for directing ink towards said slides;

said slides are mounted immediately below said second portion of said first and second crossarms;

said first crossarm means having a first taper defined by said first portion of each of said first and second crossarms;

said container has a taper towards said opening;
said first taper being configured for matching said taper of said container;
said first crossarm means having a second taper defined by said second portion of each of said first and second crossarms;
said second taper being configured for directing ink from said opening of said container to said slides;
said ink supplying means further comprises second crossarm means for slidably supporting said slides,, said second crossarm means being mounted on said frame of said printing press, said second crossarm means being mounted on said frame and extending transversely across said printing press;
said second crossarm means comprising a third crossarm and a fourth crossarm, said third and fourth crossarms being disposed parallel to one another;
said third and fourth crossarms each comprising a flat upper portion for supporting said slides;
said third and fourth crossarms defining an additional opening therebetween for permitting the flow of ink from said container, said second portion of said first and second crossarms, and said slides;
said additional opening being positioned vertically beneath said opening of said container;
each of said slides being mounted so as to overhang each of said third and fourth crossarms;
each of said slides having a first end portion and a second end portion;
said first end portion and said second end portion of each of said slides being of similar width;
each of said slides comprising a web portion for connecting said first end portion and said second end portion, said web portion being of a significantly lesser width than said first and second end portions;
said at least one open area of each of said slides being two open areas, each of said two open areas being formed by said first end portion, said second end portion and said web portion of each of said slides, said web portion being disposed between said two open areas;
said actuator means comprises first actuator means and second actuator means;
said first actuator means being disposed at said first end portions of said slides;
said second actuator means being disposed at said second end portions of said slides;
said two openings of each of said slides being positionable with respect to said opening of said container to form an effective slot width for the flow of ink therethrough;
said first crossarm having a first passage disposed therethrough;
said second crossarm having a second passage disposed therethrough;
said first and second passage comprising means for introducing washing fluid to said second portion of said first and second crossarms;
said ink supplying means comprises brush means, said brush means comprising means for being lowered to brush washing fluid on said slides upon removal of said container from said first and second crossarms;
said receiving roller is one of said plurality of inking rollers;
said portion of each of said slides having a width being less than about one-fifth of the width of said first end portion and said second end portion of each of said slides;
said first actuator means comprises a first set of a plurality of actuators, wherein one actuator is positioned adjacent said first portion of a corresponding one of said slides;
said second actuator means comprises a second set of a plurality of actuators, wherein one actuator is positioned adjacent said second portion of a corresponding one of said slides;
each of said first set of actuators comprising:
servomotor means and worm gear means interacting with said servomotor means;
a lever mounted at an end of said worm gear means;
ball bearing means mounted on said lever;
said ball bearing means being configured for pushing said first end of the corresponding slide to position said slide; and
each of said second set of actuators comprising:
servomotor means and worm gear means interacting with said servomotor means;
a lever mounted at an end of said worm gear means;
ball bearing means mounted on said lever; and
said ball bearing means being configured for pushing said second end of the corresponding slide to position said slide.

6. The printing press according to claim 4, wherein:
said ink supplying means further comprises means for closing said opening of said container to completely prevent the flow of ink to said zones through said slides;
said ink supplying means further comprises means for introducing an overpressure into said container to propel the ink through said opening;
said means for introducing an overpressure comprises means for introducing compressed air into said container;
said closing means comprises wedge means for being inserted in said opening to close said opening;
said ink supplying means further comprises means for selectively raising and lowering said wedge means to selectively open and close said opening;
said ink supplying means further comprises first crossarm means for supporting said container, said first crossarm means being mounted on said frame and extending transversely across said printing press;
said first crossarm means comprising a first crossarm and a second crossarm, said first and second crossarms being disposed parallel to one another;
said first and second crossarms each have a first portion for accommodating said container and a and a second portion for directing ink towards said slides;
said slides are mounted immediately below said second portion of said first and second crossarms;
said first crossarm means having a first taper defined by said first portion of each of said first and second crossarms;
said container has a taper towards said opening;
said first taper being configured for matching said taper of said container;
said first crossarm means having a second taper defined by said second portion of each of said first and second crossarms;

said second taper being configured for directing ink from said opening of said container to said slides;

said ink supplying means further comprises second crossarm means for slidably supporting said slides, said second crossarm means being mounted on said frame of said printing press, said second crossarm means being mounted on said frame and extending transversely across said printing press;

said second crossarm means comprising a third crossarm and a fourth crossarm, said third and fourth crossarms being disposed parallel to one another;

said third and fourth crossarms each comprising a flat upper portion for supporting said slides;

said third and fourth crossarms defining an additional opening therebetween for permitting the flow of ink from said container, said second portion of said first and second crossarms, and said slides;

said additional opening being positioned vertically beneath said opening of said container;

each of said slides being mounted so as to overhang each of said third and fourth crossarms;

each of said slides having a first end portion and a second end portion;

said first end portion and said second end portion of each of said slides being of similar width;

each of said slides comprising a web portion for connecting said first end portion and said second end portion, said web portion being of a significantly lesser width than said first and second end portions;

said at least one open area of each of said slides being two open areas, each of said two open areas being formed by said first end portion, said second end portion and said web portion of each of said slides, said web portion being disposed between said two open areas;

said actuator means comprises first actuator means and second actuator means;

said first actuator means being disposed at said first end portions of said slides;

said second actuator means being disposed at said second end portions of said slides;

said two openings of each of said slides being positionable with respect to said opening of said container to form an effective slot width for the flow of ink therethrough;

said first crossarm having a first passage disposed therethrough;

said second crossarm having a second passage disposed therethrough;

said first and second passage comprising means for introducing washing fluid to said second portion of said first, and second crossarms;

said ink supplying means comprises brush means, said brush means comprising means for being lowered to brush washing fluid on said slides upon removal of said container from said first and second crossarms;

said receiving roller is one of said plurality of inking rollers; said portion of each of said slides having a width being less than about one-fifth of the width of said first end portion and said second end portion of each of said slides;

said first actuator means comprises a single actuator, said single actuator being a first actuator;

said second actuator means comprises another single actuator being a second actuator;

said ink supplying means comprises:

means for displacing said first and second actuators, in tandem, in a direction parallel to the longitudinal dimension of said container;

a fifth crossarm for guiding the longitudinal displacement of said first actuator;

a sixth crossarm for guiding the longitudinal displacement of said second actuator; said first actuator comprising:

servomotor means and worm gear means interacting with said servomotor means;

a lever mounted at an end of said worm gear means;

ball bearing means mounted on said lever;

said ball bearing means being configured for pushing said first end of the corresponding slide to position said slide;

said second actuator comprising:

servomotor means and worm gear means interacting with said servomotor means;

a lever mounted at an end of said worm gear means;

ball bearing means mounted on said lever;

said ball bearing means being configured for pushing said second end of the corresponding slide to position said slide;

said first and second actuators being configured for flanking a predetermined one of said slides to positionally adjust said one of said slides; and said displacing means comprises:

a first toothed belt for displacing said first actuator;

a second toothed belt for displacing said second actuator;

first stepper motor means for driving said first toothed belt; and second stepper motor means for driving said second toothed belt.

7. Ink dosing apparatus for supplying ink to a plurality of inking rollers in a printing press, such a printing press comprising: a frame; a plate cylinder being rotatably mounted on the frame; a plate cylinder and for applying ink to the plate cylinder; a plurality of ink applicator rollers for being engaged with the plurality of inking rollers for applying ink to the plurality of ink applicator rollers; the plate cylinder having a printing width for accommodating ink, and the plurality of inking rollers having an inkable width corresponding to the printing width of the plate cylinder; the plurality of inking rollers defining a plurality of zones along the inkable width thereof; a receiving roller for receiving ink from said ink dosing apparatus and for distributing the ink among the plurality of inking rollers, the receiving roller having an inkable width corresponding to the inkable width of the plurality of inking rollers; said ink dosing apparatus comprising:

means for holding a supply of ink;

said holding means having a lower portion for being disposed towards the receiving roller;

at least one opening disposed in said lower portion of said holding means, said at least one opening for being positioned to supply ink to the receiving roller over substantially the entire inkable width of the receiving roller;

a plurality of slides being slidably mounted below said at least one opening;

said plurality of slides being configured for varying the flow of ink to each of said zones, each of said slides corresponding to one of said zones;

means for selectively positioning said slides to adjust said slides to vary the flow of ink to the zones corresponding to said slides;

each of said slides comprising at least one open area for permitting the flow of ink therethrough;

said at least one open area of each said slide being adjustable with respect to said at least one opening of said holding means to vary the flow of ink to the zone corresponding to each said slide; and said positioning means comprising actuator means for sliding each of said slides to adjust said at least one open area of each said slide with respect to said at least one opening of said holding means to vary the flow of ink to the zone corresponding to each said slide.

8. The printing press according to claim 7, wherein:

said holding means comprises a container for holding ink, said container having a longitudinal dimension defined parallel to the inkable width of said inking rollers; and said at least one opening is one opening, said opening comprising a slot extending over the longitudinal dimension of said holding means.

9. The printing press according to claim 8, wherein said slides are mounted side by side along the longitudinal direction of said container, to move in a direction perpendicular to the longitudinal dimension of said container.

10. The printing press according to claim 9, wherein said slides are mounted horizontally.

11. The printing press according to claim 10, wherein:

said ink dosing apparatus further comprises means for closing said opening of said container to completely prevent the flow of ink to said zones through said slides;

said ink dosing apparatus further comprises means for introducing an overpressure into said container to propel the ink through said opening;

said means for introducing an overpressure comprises means for introducing compressed air into said container;

said closing means comprises wedge means for being inserted in said opening to close said opening;

said ink dosing apparatus further comprises means for selectively raising and lowering said wedge means to selectively open and close said opening;

said ink dosing apparatus further comprises first crossarm means for supporting said container, said first crossarm means for being mounted on the frame and for extending transversely across said printing press;

said first crossarm means comprising a first crossarm and a second crossarm, said first and second crossarms being disposed parallel to one another;

said first and second crossarms each have a first portion for accommodating said container and a and a second portion for directing ink towards said slides;

said slides are mounted immediately below said second portion of said first and second crossarms;

said first crossarm means having a first taper defined by said first portion of each of said first and second crossarms;

said container has a taper towards said opening;

said first taper being configured for matching said taper of said container;

said first crossarm means having a second taper defined by said second portion of each of said first and second crossarms;

said second taper being configured for directing ink from said opening of said container to said slides;

said ink dosing apparatus further comprises second crossarm means for slidably supporting said slides, said second crossarm means being mounted on said frame of said printing press, said second crossarm means for being mounted on said frame and for extending transversely across said printing press;

said second crossarm means comprising a third crossarm and a fourth crossarm, said third and fourth crossarms being disposed parallel to one another;

said third and fourth crossarms each comprising a flat upper portion for supporting said slides;

said third and fourth crossarms defining an additional opening therebetween for permitting the flow of ink from said container, said second portion of said first and second crossarms, and said slides;

said additional opening being positioned vertically beneath said opening of said container;

each of said slides being mounted so as to overhang each of said third and fourth erossarms;

each of said slides having a first end portion and a second end portion;

said first end portion and said second end portion of each of said slides being of similar width;

each of said slides comprising a web portion for connecting said first end portion and said second end portion, said web portion being of a significantly lesser width than said first and second end portions;

said at least one open area of each of said slides being two open areas, each of said two open areas being formed by said first end portion, said second end portion and said web portion of each of said slides, said web portion being disposed between said two open areas;

said actuator means comprises first actuator means and second actuator means;

said first actuator means being disposed at said first end portions of said slides;

said second actuator means being disposed at said second end portions of said slides;

said two openings of each of said slides being positionable with respect to said opening of said container to form an effective slot width for the flow of ink therethrough;

said first crossarm having a first passage disposed therethrough;

said second crossarm having a second passage disposed therethrough;

said first and second passage comprising means for introducing washing fluid to said second portion of said first and second crossarms;

said ink dosing apparatus comprises brush means, said brush means comprising means for being lowered to brush washing fluid on said slides upon removal of said container from said first and second crossarms;

the receiving roller is one of the plurality of inking rollers;

said portion of each of said slides having a width being less than about one-fifth of the width of said first end portion and said second end portion of each of said slides;

said first actuator means comprises a first set of a plurality of actuators, wherein one actuator is positioned adjacent said first portion of a corresponding one of said slides;

said second actuator means comprises a second set of a plurality of actuators, wherein one actuator is positioned adjacent said second portion of a corresponding one of said slides;

each of said first set of actuators comprising:

servomotor means and worm gear means interacting with said servomotor means;

a lever mounted at an end of said worm gear means;

ball bearing means mounted on said lever;

said ball bearing means being configured for pushing said first end of the corresponding slide to position said slide; and each of said second set of actuators comprising:

servomotor means and worm gear means interacting with said servomotor means;

a lever mounted at an end of said worm gear means;

ball bearing means mounted on said lever; and said ball bearing means being configured for pushing said second end of the corresponding slide to position said slide.

12. The printing press according to claim 10, wherein:

said ink dosing apparatus further comprises means for closing said opening of said container to completely prevent the flow of ink to said zones through said slides;

said ink dosing apparatus further comprises means for introducing an overpressure into said container to propel the ink through said opening;

said means for introducing an overpressure comprises means for introducing compressed air into said container;

said closing means comprises wedge means for being inserted in said opening to close said opening;

said ink dosing apparatus further comprises means for selectively raising and lowering said wedge means to selectively open and close said opening;

said ink dosing apparatus further comprises first crossarm means for supporting said Container, said first crossarm means for being mounted on said frame and for extending transversely across said printing press;

said first crossarm means comprising a first crossarm and a second crossarm, said first and second crossarms being disposed parallel to one another;

said first and second crossarms each have a first portion for accommodating said container and a and a second portion for directing ink towards said slides;

said slides are mounted immediately below said second portion of said first and second crossarms;

said first crossarm means having a first taper defined by said first portion of each of said first and second crossarms;

said container has a taper towards said opening;

said first taper being configured for matching said taper of said container;

said first crossarm means having a second taper defined by said second portion of each of said first and second crossarms;

said second taper being configured for directing ink from said opening of said container to said slides;

said ink dosing apparatus further comprises second crossarm means for slidably supporting said slides, said second crossarm means being mounted on said frame of said printing press, said second crossarm means for being mounted on said frame and for extending transversely across said printing press;

said second crossarm means comprising a third crossarm and a fourth crossarm, said third and fourth crossarms being disposed parallel to one another;

said third and fourth crossarms each comprising a flat upper portion for supporting said slides;

said third and fourth crossarms defining an additional opening therebetween for permitting the flow of ink from said container, said second portion of said first and second crossarms, and said slides;

said additional opening being positioned vertically beneath said opening of said container;

each of said slides being mounted so as to overhang each of said third and fourth crossarms;

each of said slides having a first end portion and a second end portion;

said first end portion and said second end portion of each of said slides being of similar width;

each of said slides comprising a web portion for connecting said first end portion and said second end portion, said web portion being of a significantly lesser width than said first and second end portions;

said at least one open area of each of said slides being two open areas, each of said two open areas being formed by said first end portion, said second end portion and said web portion of each of said slides, said web portion being disposed between said two open areas;

said actuator means comprises first actuator means and second actuator means;

said first actuator means being disposed at said first end portions of said slides;

said second actuator means being disposed at said second end portions of said slides;

said two openings of each of said slides being positionable with respect to said opening of said container to form an effective slot width for the flow of ink therethrough;

said first crossarm having a first passage disposed therethrough;

said second crossarm having a second passage disposed therethrough;

said first and second passage comprising means for introducing washing fluid to said second portion of said first and second crossarms;

said ink dosing apparatus comprises brush means, said brush means comprising means for being lowered to brush washing fluid on said slides upon removal of said container from said first and second crossarms;

the receiving roller is one of the plurality of inking rollers;

said portion of each of said slides having a width being less than about one-fifth of the width of said first end portion and said second end portion of each of said slides;

said first actuator means comprises a single actuator, said single actuator being a first actuator;

said second actuator means comprises another single actuator being a second actuator;

said ink dosing apparatus comprises:

means for displacing said first and second actuators, in tandem, in a direction parallel to the longitudinal dimension of said container;

a fifth crossarm for guiding the longitudinal displacement of said first actuator;

a sixth crossarm for guiding the longitudinal displacement of said second actuator; said first actuator comprising:

servomotor means and worm gear means interacting with said servomotor means;

a lever mounted at an end of said worm gear means;

ball bearing means mounted on said lever;

said ball bearing means being configured for pushing said first end of the corresponding slide to position said slide;

said second actuator comprising:

servomotor means and worm gear means interacting with said servomotor means;

a lever mounted at an end of said worm gear means;

ball bearing means mounted on said lever;

said ball bearing means being configured for pushing said second end of the corresponding slide to position said slide;

said first and second actuators being configured for flanking a predetermined one of said slides to positionally adjust said one of said slides; and said displacing means comprises:

a first toothed belt for displacing said first actuator;

a second toothed belt for displacing said second actuator;

first stepper motor means for driving said first toothed belt; and second stepper motor means for driving said second toothed belt.

13. Ink dosing apparatus for supplying ink to a receiving roller of a printing press, the receiving roller having an inkable width, the receiving roller defining a plurality of zones throughout the inkable width thereof, the printing press having a frame, said ink dosing apparatus comprising:

means for holding a supply of ink;

said holding means having a lower portion for being disposed towards the receiving roller;

at least one opening disposed in said lower portion of said holding means, said at least one Opening for being positioned to supply ink to the receiving roller over substantially the entire inkable width of the receiving roller;

a plurality of slides being slidably mounted below said at least one opening;

said plurality of slides being configured for varying the flow of ink to each of said zones, each of said slides corresponding to one of said zones;

means for selectively positioning said slides to adjust said slides to vary the flow of ink to the zones corresponding to said slides;

each of said slides comprising at least one open area for permitting the flow of ink therethrough;

said at least one open area of each said slide being adjustable with respect to said at least one opening of said holding means to vary the flow of ink to the zone corresponding to each said slide; and said positioning means comprising actuator means for sliding each of said slides to adjust said at least one open area of each said slide with respect to said at least one opening of said holding means to vary the flow of ink to the zone corresponding to each said slide.

14. The apparatus according to claim 13, wherein:

said holding means comprises a container for holding ink, said container having a longitudinal dimension defined parallel to the inkable width of said inking rollers; and said at least one opening is one opening, said opening comprising a slot extending over the longitudinal dimension of said holding means.

15. The apparatus according to claim 14, wherein said slides are mounted side by side along the longitudinal dimension of said container, to move in a direction perpendicular to the longitudinal dimension of said container.

16. The apparatus according to claim 15, wherein:

said slides are mounted horizontally;

said ink dosing apparatus further comprises means for closing said opening of said container to completely prevent the flow of ink to said zones through said slides;

said ink dosing apparatus further comprises means for introducing an overpressure into said container to propel the ink through said opening;

said means for introducing an overpressure comprises means for introducing compressed air into said container;

said closing means comprises wedge means for being inserted in said opening to close said opening;

said ink dosing apparatus further comprises means for selectively raising and lowering said wedge means to selectively open and close said opening;

said ink dosing apparatus further comprises first crossarm means for supporting said container, said first crossarm means for being mounted on said frame and for extending transversely across said printing press;

said first crossarm means comprising a first crossarm and a second crossarm, said first and second crossarms being disposed parallel to one another;

said first and second crossarms each have a first portion for accommodating said container and a and a second portion for directing ink towards said slides;

said slides are mounted immediately below said second portion of said first and second crossarms;

said first crossarm means having a first taper defined by said first portion of each of said first and second crossarms;

said container has a taper towards said opening;

said first taper being configured for matching said taper of said container;

said first crossarm means having a second taper defined by said second portion of each of said first and second crossarms;

said second taper being configured for directing ink from said opening of said container to said slides;

said ink dosing apparatus further comprises second crossarm means for slidably supporting said slides, said second crossarm means being mounted on said frame of said printing press, said second crossarm means for being mounted on said frame and for extending transversely across said printing press;

said second crossarm means comprising a third crossarm and a fourth crossarm, said third and fourth crossarms being disposed parallel to one another;

said third and fourth crossarms each comprising a flat upper portion for supporting said slides;

said third and fourth crossarms defining an additional opening therebetween for permitting the flow of ink from said container, said second portion of said first and second crossarms, and said slides;

said additional opening being positioned vertically beneath said opening of said container;

each of said slides being mounted so as to overhang each of said third and fourth crossarms;

each of said slides having a first end portion and a second end portion;

said first end portion and said second end portion of each of said slides being of similar width;

each of said slides comprising a web portion for connecting said first end portion and said second end portion, said web portion being of a significantly lesser width than said first and second end portions;

said at least one open area of each of said slides being two open areas, each of said two open areas being formed by said first end portion, said second end portion and said web portion of each of said slides, said web portion being disposed between said two open areas;

said actuator means comprises first actuator means and second actuator means;

said first actuator means being disposed at said first end portions of said slides;

said second actuator means being disposed at said second end portions of said slides;

said two openings of each of said slides being positionable with respect to said opening of said container to form an effective slot width for the flow of ink therethrough;

said first crossarm having a first passage disposed therethrough;

said second crossarm having a second passage disposed therethrough;

said first and second passage comprising means for introducing washing fluid to said second portion of said first and second crossarms;

said ink dosing apparatus comprises brush means, said brush means comprising means for being lowered to brush washing fluid on said slides upon removal of said container from said first and second crossarms;

said portion of each of said slides having a width being less than about one-fifth of the width of said first end portion and said second end portion of each of said slides;

said first actuator means comprises a first set of a plurality of actuators, wherein one actuator is positioned adjacent said first portion of a corresponding one of said slides;

said second actuator means comprises a second set of a plurality of actuators, wherein one actuator is positioned adjacent said second portion of a corresponding one of said slides;

each of said first set of actuators comprising:

servomotor means and worm gear means interacting with said servomotor means;

a lever mounted at an end of said worm gear means;

ball bearing means mounted on said lever;

said ball bearing means being configured for pushing said first end of the corresponding slide to position said slide; and each of said second set of actuators comprising:

servomotor means and worm gear means interacting with said servomotor means;

a lever mounted at an end of said worm gear means;

ball bearing means mounted on said lever; and said ball bearing means being configured for pushing said second end of the corresponding slide to position said slide.

17. The apparatus according to claim 15, wherein:

said slides are mounted horizontally;

said ink dosing apparatus further comprises means for closing said opening of said container to completely prevent the flow of ink to said zones through said slides;

said ink dosing apparatus further comprises means for introducing an overpressure into said container to propel the ink through said opening;

said means for introducing an overpressure comprises means for introducing compressed air into said container;

said closing means comprises wedge means for being inserted in said opening to close said opening;

said ink dosing apparatus further comprises means for selectively raising and lowering said wedge means to selectively open and close said opening;

said ink dosing apparatus further comprises first crossarm means for supporting said container, said first crossarm means for being mounted on said frame and for extending transversely across said printing press;

said first crossarm means comprising a first crossarm and a second crossarm, said first and second crossarms being disposed parallel to one another;

said first and second crossarms each have a first portion for accommodating said container and a and a second portion for directing ink towards said slides;

said slides are mounted immediately below said second portion of said first and second crossarms;

said first crossarm means having a first taper defined by said first portion of each of said first and second crossarms;

said container has a taper towards said opening;

said first taper being configured for matching said taper of said container;

said first crossarm means having a second taper defined by said second portion of each of said first and second crossarms;

said second taper being configured for directing ink from said opening of said container to said slides;

said ink dosing apparatus further comprises second crossarm means for slidably supporting said slides, said second crossarm means being mounted on said frame of said printing press, said second crossarm means for being mounted on said frame and for extending transversely across said printing press;

said second crossarm means comprising a third crossarm and a fourth crossarm, said third and fourth crossarms being disposed parallel to one another;

said third and fourth crossarms each comprising a flat upper portion for supporting said slides;

said third and fourth crossarms defining an additional opening therebetween for permitting the flow of ink from said container, said second portion of said first and second crossarms, and said slides;

said additional opening being positioned vertically beneath said opening of said container;

each of said slides being mounted so as to overhang each of said third and fourth crossarms;

each of said slides having a first end portion and a second end portion;

said first end portion and said second end portion of each of said slides being of similar width;

each of said slides comprising a web portion for connecting said first end portion and said second end portion, said web portion being of a significantly lesser width than said first and second end portions;

said at least one open area of each of said slides being two open areas, each of said two open areas being formed by said first end portion, said second end portion and said web portion of each of said slides, said web portion being disposed between said two open areas;

said actuator means comprises first actuator means and second actuator means;

said first actuator means being disposed at said first end portions of said slides;

said second actuator means being disposed at said second end portions of said slides;

said two openings of each of said slides being positionable with respect to said opening of said container to form an effective slot width for the flow of ink therethrough;

said first crossarm having a first passage disposed therethrough;

said second crossarm having a second passage disposed therethrough;

said first and second passage comprising means for introducing washing fluid to said second portion of said first and second crossarms;

said ink dosing apparatus comprises brush means, said brush means comprising means for being lowered to brush washing fluid on said slides upon removal of said container from said first and second crossarms;

said portion of each of said slides having a width being less than about one-fifth of the width of said first end portion and said second end portion of each of said slides;

said first actuator means comprises a single actuator, said single actuator being a first actuator; said second actuator means comprises another single actuator being a second actuator; said ink dosing apparatus comprises:

means for displacing said first and second actuators, in tandem, in a direction parallel to the longitudinal dimension of said container;

a fifth crossarm for guiding the longitudinal displacement of said first actuator;

a sixth crossarm for guiding the longitudinal displacement of said second actuator; said first actuator comprising:

servomotor means and worm gear means interacting with said servomotor means;

a lever mounted at an end of said worm gear means;

ball bearing means mounted on said lever;

said ball bearing means being configured for pushing said first end of the corresponding slide to position said slide;

said second actuator comprising:

servomotor means and worm gear means interacting with said servomotor means;

a lever mounted at an end of said worm gear means;

ball bearing means mounted on said lever;

said ball bearing means being configured for pushing said second end of the corresponding slide to position said slide;

said first and second actuators being configured for flanking a predetermined one of said slides to positionally adjust said one of said slides; and said displacing means comprises:

a first toothed belt for displacing said first actuator;

a second toothed belt for displacing said second actuator;

first stepper motor means for driving said first toothed belt; and second stepper motor means for driving said second toothed belt.

* * * * *

UNITED STATES PATENT AND TRADEMARK OFFICE

CERTIFICATE OF CORRECTION

PATENT NO. : 5,386,773
DATED : February 7, 1995
INVENTOR(S) : Gregor Flade

It is certified that error appears in the above-indentified patent and that said Letters Patent is hereby corrected as shown below:

In column 6, line 28, after 'activate' delete "Servomotors" and insert --servomotors--.

In column 10, line 11, Claim 1, after 'area' delete "Of" and insert --of--.

In column 14, lines 41-42, Claim 7, after 'frame;' delete "a plate cylinder and for applying ink to the plate cylinder;".

In column 14, line 42, Claim 7, after 'the' insert --plate cylinder and for applying ink to the plate cylinder; a--.

In column 17, line 43, Claim 12, after 'said', first occurrence, delete "Container" and insert --container--.

In column 19, line 44, Claim 13, after 'one' delete "Opening" and insert --opening--.

Signed and Sealed this

Thirteenth Day of August, 1996

*Attest:*

Bruce Lehman

BRUCE LEHMAN

*Attesting Officer*

*Commissioner of Patents and Trademarks*